US006328614B1

(12) United States Patent
Osawa

(10) Patent No.: US 6,328,614 B1
(45) Date of Patent: Dec. 11, 2001

(54) CONNECTOR

(75) Inventor: Hiroki Osawa, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/610,003

(22) Filed: Jul. 5, 2000

(30) Foreign Application Priority Data

Jul. 28, 1999 (JP) ..... 11-214272

(51) Int. Cl.[7] ..... H04R 13/514
(52) U.S. Cl. ..... 439/752
(58) Field of Search ..... 439/595, 752

(56) References Cited

U.S. PATENT DOCUMENTS 6,126,484 * 10/2000 Klein et al. ..... 439/595
6,129,596 * 10/2000 Yamatani ..... 439/752

FOREIGN PATENT DOCUMENTS

WO 98/52252 11/1998 (WO) .

* cited by examiner

*Primary Examiner*—Khiem Nguyen
(74) *Attorney, Agent, or Firm*—Banner & Witcoff, Ltd.

(57) ABSTRACT

Retainers 18 provided on an electrical connector housing 10 become approximately level with an outer wall of the connector housing 10 when terminal fittings 20 are inserted and, moreover, are maintained in a second stopping position whereby these retainers 18 are engaged with the terminal fittings 20. Outer faces of the terminal fittings 20 interfere with the retainers 18 as these terminal fittings are inserted, thereby causing the retainers 18 to bend resiliently and move to a position whereby they protrude form the outer wall of the connector housing 10. Then, after the terminal fittings 20 have reached a correct inserted position, the retainers 18 return resiliently to their second stopping position, engage with the terminal fittings 20, and prevent these terminal fittings 20 from being removed. At the point when the terminal fittings 20 are about to be inserted, the retainers 18 remain in a state whereby they do not protrude from the outer face of the connector housing 10. Consequently, there is no danger that the retainers 18 will be moved inadvertently to an obstructing condition.

21 Claims, 5 Drawing Sheets

CONNECTOR

TECHNICAL FIELD

The present invention relates to an electrical connector provided with a means for doubly retaining terminal fittings.

BACKGROUND TO THE INVENTION

One example of a connector provided with means for doubly retaining terminal fittings is shown in JP-10-312847. As shown in FIG. 12 of this specification, this connector comprises a connector housing 1 having a plurality of cavities 2 formed therein. terminal fittings (not shown) being inserted into these cavities 2. A resiliently bendable lance 3 is formed on an inner wall of each cavity 2, and a retainer 4 is formed on an outer wall section, opposing the lance 3, of each cavity 2. Each retainer 4 has a cantilevered shape, is in the vicinity of an outer face of the connector housing 1, and is formed in a unified fashion with this connector housing 1, being joined thereto by a hinge 5. When the retainer 4 is in the form in which it has been moulded, it is out of the insertion path of the terminal fitting as this terminal fitting is inserted into the cavity 2, and is in a shape whereby it protrudes outwards from the outer face of the connector housing 1. In this form, the terminal fitting is inserted into the cavity 2 without interference, and the inserted terminal fitting is retained by the lance 3. Thereupon, the retainer 4 is pushed into the cavity 2 and engages with the terminal fitting, thereby doubly retaining this terminal fitting.

In this connector, the retainer 4 protrudes outwards from the outer face of the connector housing 1 when it is in the form in which it has been moulded. Consequently, there is the danger that the retainer 4 may be pushed into the connector housing 1 when it is being ejected from the mould or when it is being transported from the moulding site to the site where the terminal fittings are attached. If the terminal fitting is inserted when the retainer 4 has been incorrectly positioned, the terminal fitting will engage with the retainer 4, and the insertion operation will be impeded.

The present invention has been developed after taking the above problem into consideration, and aims to present a connector wherein incorrect positioning is prevented of a retainer that is provided on a connector housing, this retainer serving a double retaining function.

SUMMARY OF THE INVENTION

According to the invention there is provided an electrical connector housing having a cavity extending therethrough, said cavity being adapted to receive an electrical terminal in one direction, and being provided with a resilient inwardly directed lance for restraining a terminal from movement against said direction, wherein said housing further includes a retainer movable from a first condition outside said cavity to a second condition inside said cavity whereby a terminal can be engaged and doubly restrained from movement against said direction, said retainer comprising a resilient arm, in the second condition said retainer being substantially flush with the outer surface of said housing, being bendable outwardly of said cavity by insertion of a terminal in the cavity, and being adapted to resiliently return to and doubly restrain said terminal at a predetermined terminal insertion depth.

Such a resilient retainer can be moved from outside the housing to inside the cavity in the usual manner to doubly restrain a terminal, but if accidentally moved to the interior condition it still permits a terminal to be installed.

The retainer may be mounted on a support hinged to the housing body, for example by an integral plastic hinge, and one support may have several retainers mounted thereon, one for each of several cavities in the housing; this permits retainers to be moved both into and out of the housing as a unit, thus avoiding the necessity of individual operation. The support may extend in the same direction as the retainer, and the retainer may be bendable through an aperture of the support so as to protrude to the exterior of the housing and indicate a half-fitted terminal condition.

BRIEF DESCRIPTION OF DRAWINGS

Other features of the invention will be apparent from the following description of a preferred embodiment shown by way of example only in the accompanying drawings in which.

DESCRIPTION OF PREFERRED EMBODIMENT

Figure 1:
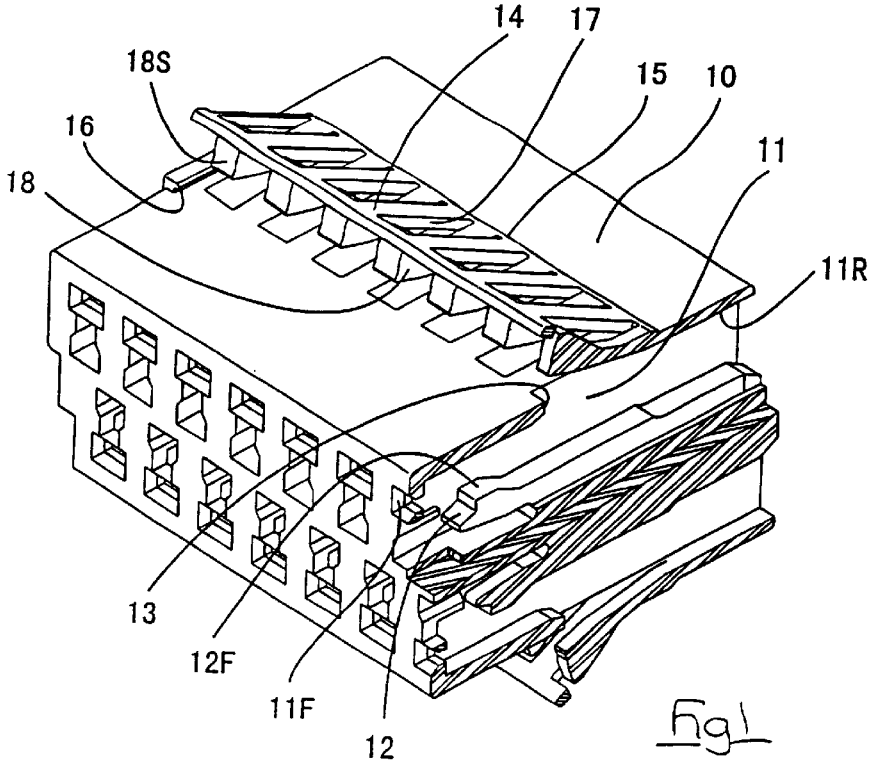
FIG. 1 is a partially cut-away diagonal view of embodiment 1 showing a state immediately after moulding.
Figure 2:
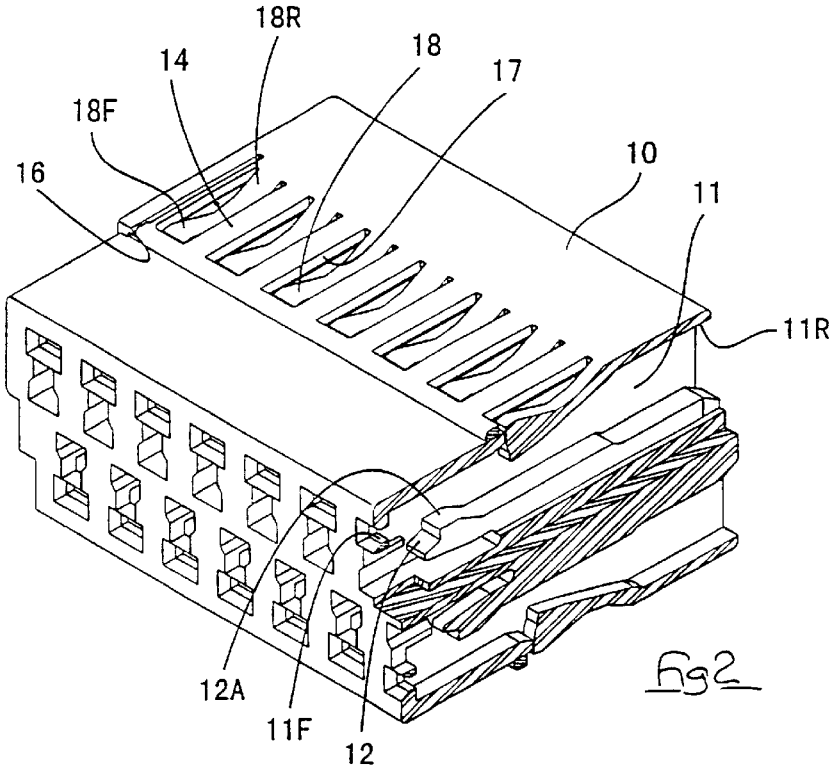
FIG. 2 is a partially cut-away diagonal view showing a supporting member in an attached state.

An embodiment of the present invention is described below with the aid of FIGS. 1 to 11.

A connector has a connector housing 10 and a plurality of terminal fittings 20.

Each terminal fitting 20 is formed by bending electrically conducting sheet metal. An anterior end portion thereof forms an angular-tubular shaped fitting member 21 for fitting together with a male terminal fitting (not shown) of a corresponding connector 30, and a posterior end portion thereof forms an electric wire attaching member 23 for crimping to an electric wire 22. Furthermore, the fitting member 21 has a first stopping hole 24 formed therein, this first stopping hole 24 retaining a lance 12 (to be explained). Similarly, a posterior end portion of the fitting member 21 forms a step-shape, this forming a second stopping stepped member 25 for engaging a retainer 18 (to be explained).

The connector housing 10 is formed from plastic, the interior thereof having a plurality of cavities 11 for housing the terminal fittings 20. These cavities 11 open onto anterior and posterior side faces of the connector housing 10. The openings of the cavities 11 that open onto the anterior side face form insertion holes 11F which allow the male terminal fittings (not shown) of the corresponding connector 30 to be inserted. These male terminal fittings which have been inserted from the insertion holes 11F make contact with the terminal fittings 20 within the cavities 11. The openings of the cavities 11 that open onto the posterior side face form terminal insertion holes 11R, the terminal fittings 20 being inserted into the cavities 11 therefrom.

Arm-like lances 12 which protrude towards the anterior in a cantilevered shape are formed from a portion of wall members which form the cavities 11. Specifically, the lances 12 are formed from the wall members opposite those wall members which connect to the outer wall of the connector housing 10. These lances 12 are resiliently bendable in a direction at a right angle relative to the direction of insertion of the terminal fittings 20 within the cavities 11, and are provided with a first stopping protrusion 12A located near their protruding ends. The lances 12 are usually in a first stopping position, whereby the first stopping protrusions 12A protrude into the cavities 11 (along the range of insertion and removal of the terminal fittings 20). However, they are capable of resiliently moving to a removed position, whereby the first stopping protrusions 12A are removed to the exterior of the cavities 11. An anterior edge of the fitting member 21 makes contact from the posterior with the first stopping protrusion 12A the terminal fitting 20 is halfway to being inserted into the cavity 11. Consequently, the lance 12 resiliently moves into the removed position and, when the terminal fitting 20 reaches the correct fitting position, the lance 12 returns resiliently to its original position and the first stopping protrusion 12A is retained in the first stopping hole 24. By this means, the terminal fitting 20 is maintained in a first retained state whereby its movement in a direction of removal is regulated.

Figure 3:
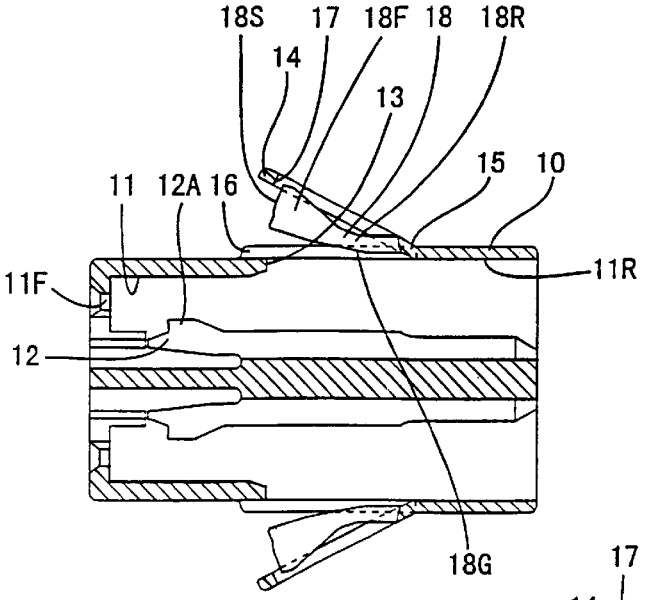
FIG. 3 is a vertical cross-sectional view showing a terminal fitting in the state immediately after its moulding (in a state whereby the supporting member is not attached to a connector housing).
Figure 4:
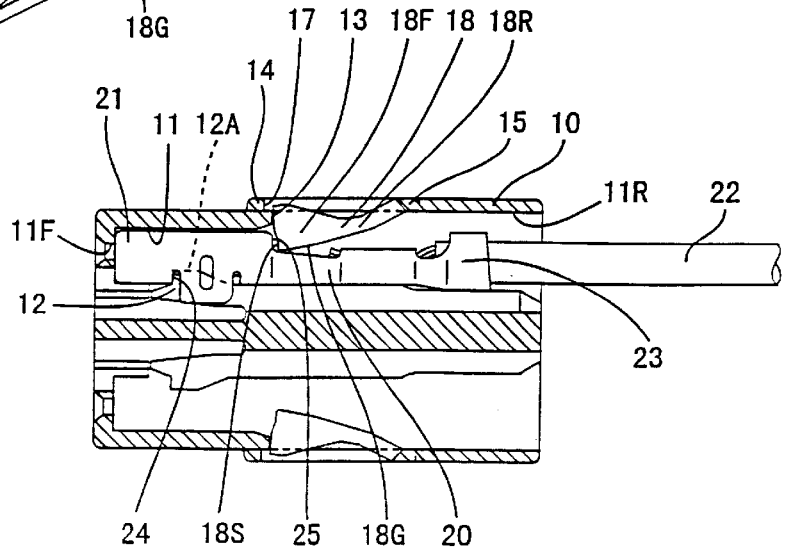
FIG. 4 is a vertical cross-sectional view showing the terminal fitting in a correctly inserted state.
Figure 6:
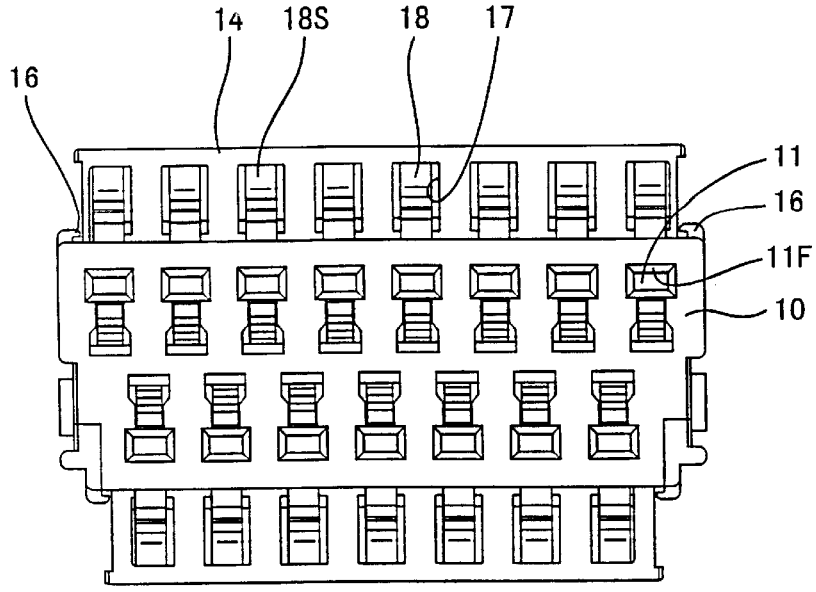
FIG. 6 is a face view showing the state immediately after moulding.
Figure 7:
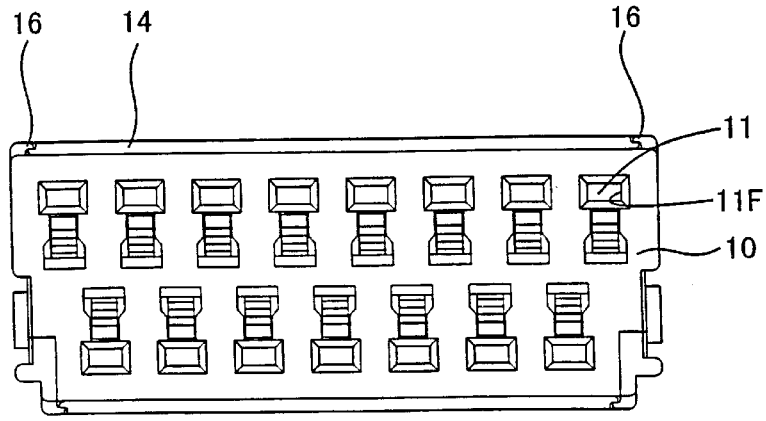
FIG. 7 is a face view showing the supporting member in the attached state.
Figure 8:
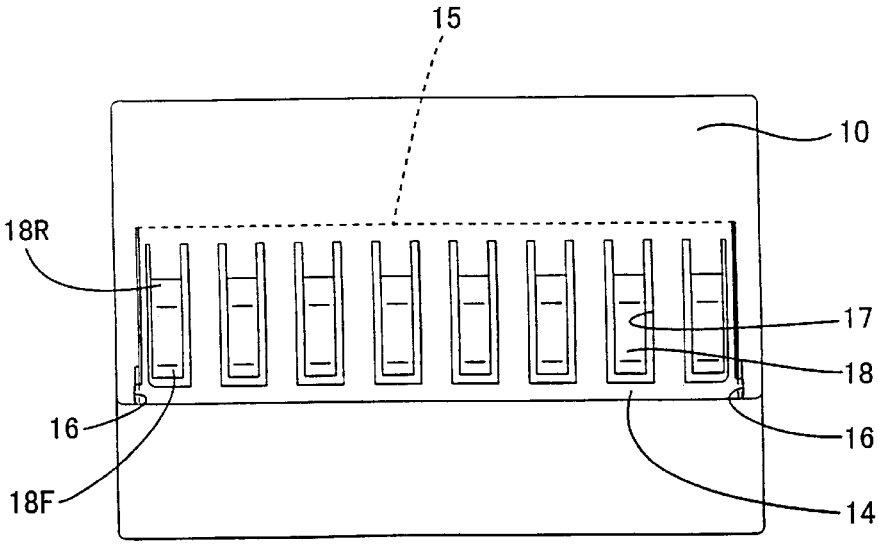
FIG. 8 is a plan view showing the supporting member in the attached state.
Figure 9:
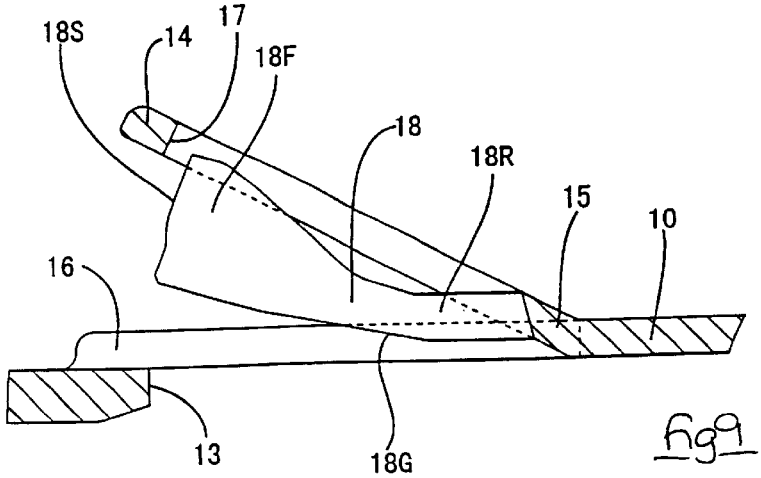
FIG. 9 is a partial enlargement of FIG. 3.
Figure 10:
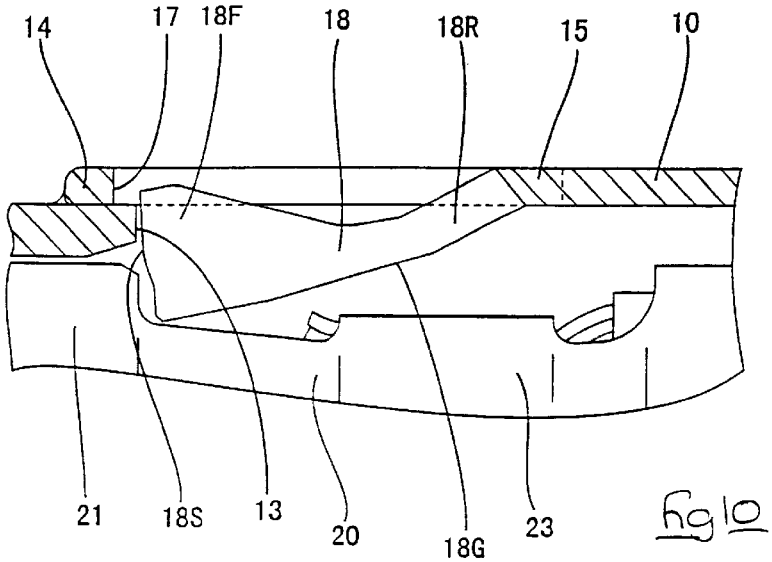
FIG. 10 is a partial enlargement of FIG. 4.
Figure 11:
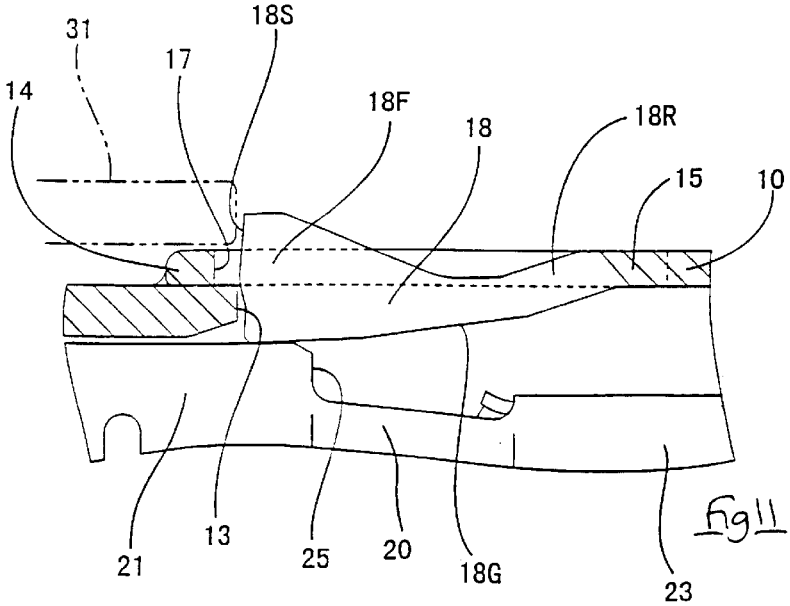
FIG. 11 is a partial enlargement of FIG. 5.
Figure 12:
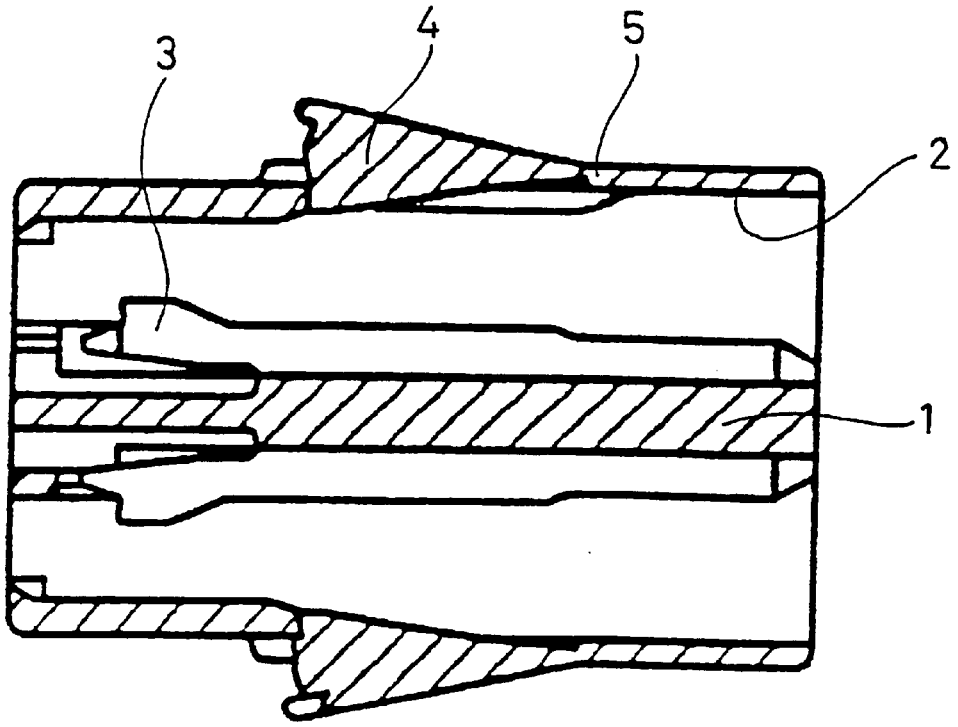
PRIOR ART Fig 12
FIG. 12 is a cross-sectional view of a conventional example.

The means to doubly retain the terminal fittings 20 is formed on the wall members which form the cavities 11, specifically, on the wall members which connect to the outer wall of the connector housing 10. This doubly-retaining means comprises long and narrow attachment holes 13 formed in the outer wall of the connector housing 10, these attachment holes 13 being formed in an anterior-posterior direction (the direction of insertion and removal of the terminal fittings 20). The attachment holes 13 pass through from the outer face of the connector housing 10 to the inner portion of the cavities 11, and a separate attachment hole 13 is provided for each cavity 11. Further, a supporting member 14 is formed on the outer face of the connector housing 10, this supporting member 14 having a rectangular plate shape and extending towards the anterior from a position at the posterior ends of the attachment holes 13. The supporting member 14 is formed in a unified manner with the connector housing 10, being joined thereto by hinge members 15 located at the posterior ends of the attachment holes 13. As shown in FIGS. 1, 3, and 6. the form thereof is such that the supporting member 14 extends, at an incline, outwards and to the anterior relative to the connector housing 10. The supporting member 14 is capable of moving, using the hinge members 15 as a fulcrum, so as to fit closely with the outer face of the connector housing 10 and so as to cover the attachment holes 13 (see FIGS. 2, 4, and 7). Moreover, stopper members 16 are formed at left and right edges of the outer face of the connector housing 10. These stopper members 16 engage with left and right edges of the inclined end of the supporting member 14, thereby locking the supporting member 14 in a tightly attached state with the outer face of the connector housing 10.

Long and narrow rectangular window holes 17 extending in an anterior-posterior direction are formed in the supporting member 14, these window holes 17 corresponding with the attachment holes 13. A plurality of retainers 18 are formed on these window holes 17, these retainers 18 extending towards the anterior in a cantilevered shape. The anterior half of each retainer 18 forms a main body 18F which is wedge-shaped if viewed from the side, the thickness thereof increasing towards the anterior. The posterior half of each retainer 18 forms a thin, long and narrow supporting member 18R. Each retainer 18 is formed in a unified manner with the supporting member 14, a posterior end of the supporting member 18R of each retainer 18 joining with a posterior edge of the window hole 17. An anterior end face of each retainer 18 forms a second stopping face 18S which engages with the second stopping stepped member 25 of the terminal fitting 20. Moreover, inner sides of both the main body 18F and the supporting member 18R join together in an approximately flat shape. By contrast, the outer sides thereof join together in a concave manner.

As shown in FIG. 3, when the retainers 18 are in their moulded state, they are located (when viewed from the side) to the inner side (towards the connector housing 10) with respect to the supporting member 14, but to the outer side with respect to the connector housing 10. However, when the supporting member 14 is moved into an attaching state, the retainer 18 is housed within the attachment hole 13 and is maintained in the second stopping position (see FIG. 4). In this state the outer faces of the retainer 18 is approximately level with the outer face of the connector housing 10 (and of the supporting member 14). That is, the retainer 18 is in a state whereby it does not protrude from the outer face. An inner face of each retainer 18, covering the entire area from the main body 18F to the supporting member 18R. forms a guiding inclined face 18G. This guiding inclined face 18G is smooth, without steps or unevenness, is inclined relative to the direction of insertion of the terminal fitting 20, and enters the cavity 11 (into the range of insertion and removal of the terminal fitting 20). Furthermore, each retainer 18 is capable of being bent individually in a resilient manner in a direction at an approximate right angle to the direction of insertion and removal of the terminal fitting 20. The posterior edge of the supporting member 18R serves as a fulcrum. When the retainer 18 is resiliently bent outwards, the main body 18F is removed from the range of insertion and removal of the terminal fitting 20.

Immediately after moulding, the supporting member 14 is in a state whereby it protrudes in an inclined manner to the exterior of the connector housing 10. Consequently, when the terminal fittings 20 are to be inserted, the supporting member 14 is moved, prior to the insertion operation, to a tightly attached state close to the outer face of the connector housing 10, and is locked in that state. Furthermore, in the case whereby the supporting member 14 is inadvertently caused to move into the attached state close to the outer face of the connector housing 10, this movement being caused by impact when it is ejected from the mould, it merely needs to be verified whether the supporting member 14 is in a locked state, and there is no need to move the supporting member 14 to the attached state.

Figure 5:
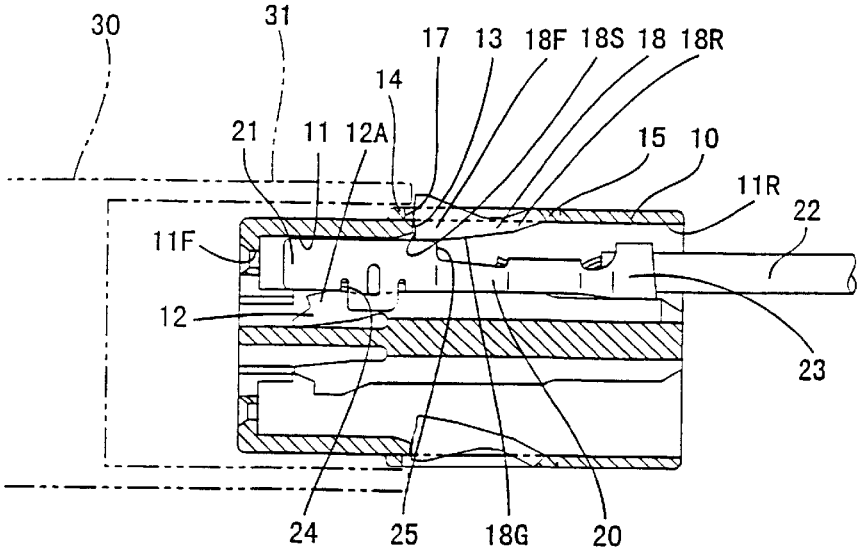
FIG. 5 is a vertical cross-sectional view showing the terminal fitting in a half inserted state.

When each terminal fitting 20 is inserted from this state, the anterior end of the fitting member 21 of the terminal fitting 20 makes contact with the guiding inclined face 18G of the retainer 18 as this insertion is taking place, and the inclination of the guiding inclined face 18G allows the terminal fitting 20 to cause the retainer 18 to bend outwards smoothly and resiliently. Then, as the insertion of the terminal fitting 20 continues, the anterior inner edge of the main body 18F of the retainer 18 and an outer face of the fitting member 21 make contact. As shown in FIG. 5, while the retainer 18 is in this resiliently bent-outwards state due to the interference with the terminal fitting 20, the anterior outer edge of the main body 18F of the retainer 18 protrudes to the exterior of the outer face of the supporting member 14. Further, as insertion is taking place, the lances 12 also interfere with the outer faces of the fitting members 21 and are resiliently bent.

When the terminal fitting 20 reaches the correct inserted position, the outer face of the fitting member 21 separates from the anterior edge of the retainer 18, and the retainer 18 returns to its second stopping position due to its resilient returning force. Then, the second stopping face 18S of the retainer 18 engages from the posterior with the second stopping stepped member 25 of the terminal fitting 20. By this means, the terminal fitting 20 is in a doubly stopped state whereby its removal is prevented. Furthermore, as the second retaining operation is being performed by the retainer 18, the first retaining operation is also being performed by the lance 12. The terminal fitting 20 is thereby reliably maintained in a doubly stopped state whereby its removal is prevented.

Moreover, in the case whereby the terminal fitting 20 is inserted only part-way to the correct inserted position and remains in this half-inserted state, the retainer 18 which interferes with this half-inserted terminal fitting 20 is moved to a position which is further outwards relative to the other retainers 18, and its state can be verified visually through the window hole 17 of the supporting member 14. By this means, the half-inserted state of the terminal fitting 20 can be detected. Furthermore, even if the half-inserted state is not detected visually and is overlooked at the attachment stage, it will be detected when the corresponding connector 30 is fitted with the connector housing 10. That is, because the anterior end portion of the retainer 18 protrudes outwards relative to the supporting member 14, an anterior edge of a hood member 31 of the corresponding connector 30 will strike against the protruding portion of the retainer 18 as this hood member 31 is being fitted over the outer face of the connector housing 10. The fitting operation will thereby be prevented from continuing, and the half-inserted state can be detected by this means.

In connectors of the type which need retainers to protrude outwards from the outer face of a connector housing when terminal fittings are to be inserted, there is the danger that the retainers may inadvertently be moved so as to form a unified face with the outer face of the connector housing, thereby impeding the insertion of the terminal fittings. However, in the present embodiment, the retainers 18 remain in a state whereby they do not protrude from the outer face of the connector housing 10 at the time that the terminal fittings 20 are to be inserted. As a consequence, there is no danger that the retainers 18 may inadvertently be moved, and the terminal fittings 20 can be inserted without hindrance.

Furthermore, in a configuration whereby each of the retainers is directly linked to one another and they bend simultaneously, the second stopped state of the retainers relative to the terminal fittings which have been inserted first may be temporarily released when, after the initial insertion of the terminal fittings, further terminal fittings are inserted and the retainers bend therewith. However, in the present embodiment, each retainer 18 bends separately within each cavity 11. Consequently, the second stopped state of the terminal fittings 20 is maintained without interruption, and the reliability of the retaining operation is improved.

Further, when the terminal fittings 20 are being doubly stopped by the retainers 18, moving the supporting member 14 will cause the plurality of retainers 18 to be simultaneously removed from doubly retaining the terminal fittings 20. As a consequence, the retainers 18 do not need to be removed individually from the terminal fittings 20, and operability is thereby improved.

Moreover, the supporting member 14 and the retainers 18 are moulded in a unified manner with the connector housing 10. Consequently, compared to a configuration whereby these are formed as separate components which must be attached, the number of components decreases, and the number of attachment operations also decreases.

Furthermore, the present invention is not limited to the embodiments described above with the aid of figures. For example, the possibilities described below also lie within the technical range of the present invention. In addition, the present invention may be embodied in various other ways without deviating from the scope thereof.

(1) In the embodiment described above, a plurality of retainers are supported by one supporting member. However, according to the present invention, the retainers may equally well be supported directly by the connector housing, without providing a supporting plate. In that case, the outer face of the retainers may be formed so as to form a unified face with the outer face of the connector housing.

(2) In the embodiment described above, each retainer bends separately as the terminal fittings are being inserted. However, according to the present invention, there may equally well be a joined configuration whereby a plurality of retainers bend simultaneously.

(3) In the embodiment described above, the supporting member and the retainers are formed in a unified manner with the connector housing. However, according to the present invention, the supporting member and the retainers may equally well be formed as components separate from the connector housing.

(4) In the embodiment described above, the terminal fittings are female and have angular-tubular shaped fitting members. However, the present invention is also suitable for a case whereby the terminal fittings are male and have male tabs.

What is claimed is:

1. An electrical connector housing defining a cavity extending therethrough, said cavity being adapted to receive an electrical terminal in one direction, and being provided with a resilient inwardly directed lance for restraining a terminal from movement against said direction, wherein said housing further includes a retainer movable from a first condition outside said cavity to a second condition inside said cavity whereby a terminal can be engaged and doubly restrained from movement against said direction, said retainer comprising a resilient arm, in the second condition said retainer being in a retaining position and substantially flush with the outer surface of said housing, said retainer being deflectable outwardly of said cavity by and for insertion of a terminal in the cavity, and said retainer biased to resiliently return to the retaining position to doubly restrain said terminal at a predetermined terminal insertion depth.

2. A housing according to claim 1 wherein said retainer extends from a support provided on said housing, and being movable relative to said support.

3. A housing according to claim 2 wherein said support is connected to said housing by a hinge.

4. A housing according to claim 3 wherein said support and retainer extend in substantially the same direction from said hinge.

5. A housing according to claim 4 wherein said support and retainer extend in the terminal insertion direction.

6. A housing according to claim 2 wherein said support is substantially planar, and said retainer is bendable through an aperture of said support.

7. A housing according to claim 3 wherein said support is substantially planar, and said retainer is bendable through an aperture of said support.

8. A housing according to claim 4 wherein said support is substantially planar, and said retainer is bendable through an aperture of said support.

9. A housing according to claim 5 wherein said support is substantially planar, and said retainer is bendable through an aperture of said support.

10. A housing according to claim 6 wherein in the second condition said retainer is adapted to protrude through said aperture on being bent outwardly of said cavity by insertion of a terminal.

11. A housing according to claim 7 wherein in the second condition said retainer is adapted to protrude through said aperture on being bent outwardly of said cavity by insertion of a terminal.

12. A housing according to claim 8 wherein in the second condition said retainer is adapted to protrude through said aperture on being bent outwardly of said cavity by insertion of a terminal.

13. A housing according to claim 9 wherein in the second condition said retainer is adapted to protrude through said aperture on being bent outwardly of said cavity by insertion of a terminal.

14. A housing according to claim 2 wherein said support is latchable substantially flush with the surface of said housing.

15. A housing according to claim 1 and having a plurality of said cavities and a plurality of said retainers, one for each cavity.

16. A housing according to claim 2 and having a plurality of said cavities, a plurality of said retainers one for each cavity, and a single support from which said retainers extend.

17. A housing according to claim 3 and having a plurality of said cavities, a plurality of said retainers one for each cavity, and a single support from which said retainers extend.

18. A housing according to claim 4 and having a plurality of said cavities, a plurality of said retainers one for each cavity, and a single support from which said retainers extend.

19. A housing according to claim 5 and having a plurality of said cavities, a plurality of said retainers one for each cavity, and a single support from which said retainers extend.

20. A housing according to claim 6 and having a plurality of said cavities, a plurality of said retainers one for each cavity, and a single support from which said retainers extend.

21. An electrical connector housing defining a cavity extending therethrough, said cavity being adapted to receive an electrical terminal in one direction, and being provided with a resilient inwardly directed lance for restraining a terminal from movement against said direction, wherein said housing further includes a retainer movable from a first condition outside said cavity to a second condition inside said cavity whereby a terminal can be engaged and doubly restrained from movement against said direction, said retainer comprising a resilient arm, in the second condition said retainer being substantially flush with the outer surface of said housing, being bendable outwardly of said cavity by insertion of a terminal in the cavity, and being adapted to resiliently return to and doubly restrain said terminal at a predetermined terminal insertion depth, wherein said retainer extends from a support provided on said housing and is movable relative to said support, said support is connected to said housing by a hinge and is substantially planar, said retainer is bendable through an aperture of said support, and in the second condition said retainer is adapted to protrude through said aperture on being bent outwardly of said cavity by insertion of a terminal.

* * * * *